United States Patent [19]

Piper

[11] 4,136,979

[45] Jan. 30, 1979

[54] PAPER GUIDANCE SYSTEMS

[75] Inventor: Ronald N. Piper, London, England

[73] Assignee: Data Recording Instrument Company Limited, Great Britain

[21] Appl. No.: 848,064

[22] Filed: Nov. 3, 1977

Related U.S. Application Data

[63] Continuation of Ser. No. 700,719, Jun. 28, 1976, abandoned.

[51] Int. Cl.[2] ..... B41J 15/00

[52] U.S. Cl. ..... 400/616.2

[58] Field of Search ..... 270/10, 32, 43, 52, 270/52.5; 101/223–230; 197/133 P, 133 R, 133 E; 226/113, 191, 193; 29/121.1, 121.5, 121.6; 400/616–616.3, 611

[56] References Cited

U.S. PATENT DOCUMENTS

| | | | |
|---|---|---|---|
| 2,302,704 | 11/1942 | Mabon | 197/133 P |
| 2,839,176 | 6/1958 | Metzner | 197/133 P |
| 3,298,581 | 1/1967 | Huck | 226/193 X |
| 3,799,313 | 3/1974 | Shevick | 197/133 P |

*Primary Examiner*—Edgar S. Burr
*Assistant Examiner*—A. Heinz
*Attorney, Agent, or Firm*—George R. Douglas, Jr.; Sherman Levy; Anthony D. Cennamo

[57] ABSTRACT

Apparatus for reducing the possibility of wrinkling arising during the feed of multi-layer strip material along a feed path including a change of direction, the apparatus including a rotatable paddle-like paper guide having blades which successively engage the inner layer of the strip material in such manner that any excess material which would contribute to the formation of the wrinkles is accommodated in the space defined between adjacent blades.

2 Claims, 1 Drawing Figure

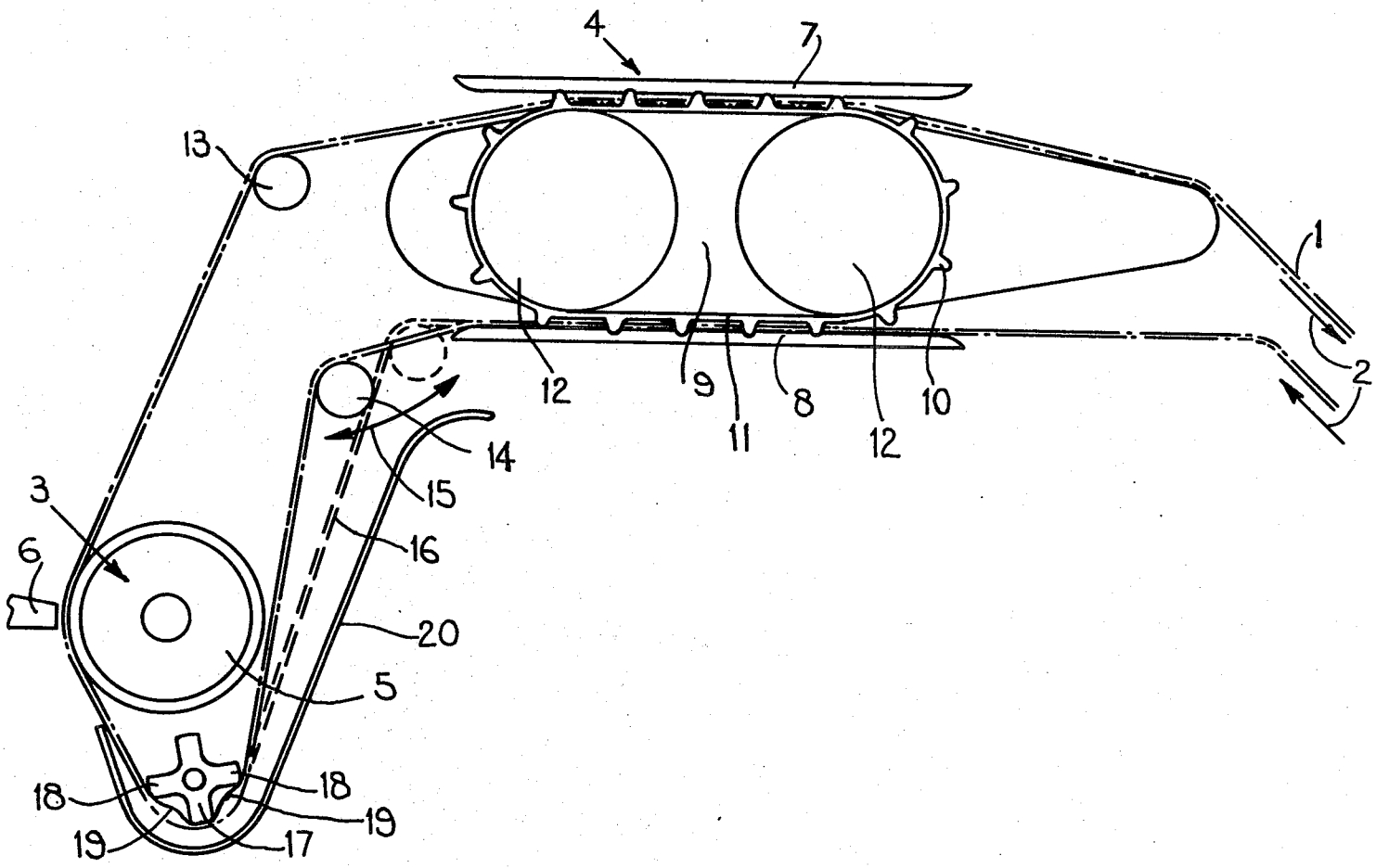
1
2
7
4
10
12
8
11
9
12
13
14
15
16
20
5
18
19
17
3
6
18
19

PAPER GUIDANCE SYSTEMS

This application is a Continuation Application of Application Ser. No. 700,719, filed June 28, 1976, which is now abandoned.

BACKGROUND OF THE INVENTION

FIELD OF THE INVENTION

This invention relates to the feed of strip material comprising a plurality of layers or laminations.

In particular, the present invention is concerned with the feeding of multi-part stationery, such as is used with printers for producing the printed output of data processing installations.

Printers used for producing such printed output can, broadly speaking, be divided into major forms in so far as the printing platen is concerned, namely, a cylindrical platen type a flat or substantially, flat platen or a strip or bar platen. In the case of the cylindrical platen, the platen can be rotatable or fixed.

Furthermore, in each form of printer the feed path of the paper to the printer is likely to involve a change in the direction of the paper feed which produces a need to bend or fold the paper through an arc which can be sufficiently acute or sharp as to produce a relative movement between the layers or laminations.

For example, in printers using a cylindrical platen it is normally necessary to turn the paper web through an arc so as to deliver the paper web to the print position.

Furthermore, with a view to reducing the overall dimensions of a machine it is frequently desirable to convolute or otherwise fold the paper web back-on itself to facilitate both feed from a supply paper web and the correct presentation of the paper web to the printing platen whether it be a rotary cylinder, platen, flat bed platen or a strip or bar platen.

It is a common practice with a view to maintaining the correct relative positioning of the various layers of the multi-layer web to use an adhesive to stick the web edges together, or to clamp or crimp the layers together at various locations along the length of the web. This correct relative positioning is particularly important where the various parts comprise printed stationery of the kind where the printing is intended to be effected at predetermined positions on the stationery. This crimping is additional to the conventionally provided lines of sprocket holes for co-operating with the drive sprocket wheels or tractors which are used to feed the paper relative to the platen printing position.

Such crimping or other edge clamping introduces a problem in maintaining any required interlayer registration during the bending or turning of the paper web through an arc. The problem arises from the geometry of the system in that if a composite web is bent through an arc the arcuate length of the outer layer is greater than that of the inner layer. Consequently, the inner layers will need to undergo relative movement with respect to the outer most layer to compensate for the change in path length. However, because of the crimping or other arrangements provided for maintaining registration; the layers are not free easily to move relative to each other. Consequently, depending upon factors such as the extent of the direction change in the paper web feed; the radii of curvature of the rolls or the like producing the relative displacement between the layers and; the surface characteristics of the paper layers; and the frequency of edge clamping or crimping, the inner layers are prone to becoming wrinkled or creased.

In view of the tension applied to the paper web which is effectively stationary i.e., the outer web in particular, the tension in the latter does not allow room for the wrinkles to be accommodated within the arc of travel around which the paper web is being fed. Consequently, the paper forming the wrinkles tend to be squeezed back towards the next approaching crimping or clamping at the edges. The forces produced by the squeezing back of the wrinkles tend to break the crimping or other edge jointing and also cause a considerable frictional drag to develop between the platen surface over which the paper web is moving and the inner sheet of the web. This effect can cause the inner sheet or sheets progressively to move back relative to the remaining sheets of the web so that they ultimately become grossly misaligned with the conventionally used sprocket wheel teeth or the pins of the tractor drivers used to advance the paper web thereby producing a fracture condition in the paper feed or damage to the sprocket holes in the paper.

The above problems have been found to be very apparent in the case of a guide surface for the paper such as, for example, a non-rotatable platen or a printer. However, the advantage of using a guide surface such, as for example, a rotatable platen has been found to be less than expected by reason of the paper acceleration and platen inertia.

It is an object of the present invention to provide means for facilitating feed of a multi-part or layer web of strip material in which the susceptability to the formation of wrinkles is at least reduced.

SUMMARY OF THE INVENTION

Broadly, according to a first aspect of the present invention there is provided apparatus for at least reducing wrinkling of an inner layer of multi-layer strip material with respect to an outer layer of the multi-layer strip material, arising from change of the feed direction during feed of the strip material, said apparatus including rotatable guide means engageable with the inner layer of the strip material at the location of which the feed direction is changed, and having means for cyclicly allowing variation of the feed path length for the inner layer during the passage of the material relative to the guide means.

Preferably, the rotatable guide means includes a rotatable member having regularly radially extending elements spaced arranged successively to engage with the inner layer, the arrangement being such that during the passage of a wrinkled portion of the strip material, excess material of the layer(s) contributing to the formation of the wrinkles accommodated within the space defined between adjacent ones of said elements.

BRIEF DESCRIPTION OF THE DRAWINGS

For a better understanding of the invention and to show how to carry the same into effect reference will now be made to the accompanying drawing the single FIGURE of which schematically illustrates an embodiment of apparatus of the present invention; as applied to a printer installation having cyclindrical platen.

DESCRIPTION OF THE PREFERRED EMBODIMENT

In the FIGURE a multi-path web 1 of stationery is moved in the direction of arrows 2, past a printing station 3 by means of the drive arrangement 4.

The printing station 3 includes a cylindrical platen 5 and associated print element 6 only one of which elements 6 is shown. The platen 5 can either be rotatable or fixed.

The driving arrangement includes a pair of spaced apart web guides 7, 8 which co-operates with a guide block 9. The co-operation of the block 9, with the associated guides 7 and 8 defines narrow channels through which the web 1 passes towards and away from the printing station. The paper web is advanced by means of tractor pins 10, provided on endless belt 11 carried on wheels 12, driven by a drive not shown, In the drawing only one belt 11 is shown.

As will be seen from the FIGURE the axis of rotation of the platen is offset with respect to the axes of the tractor wheels 12 so that the web 1 does not travel in a rectilinear path between the printing station and the guides 7, 8. To maintain the desired path of the paper, guide rollers or rods 13, 14 are placed at convenient locations in the path. To provide a convenient control of the paper web tension the roll 14 is positionally displaceable as indicated by the arrow 15, so as to vary the effective path length for the web. The dashed line 16 illustrates an alternative path of the web.

With a view to reducing the length of the arc of the wrap of the web around the printing platen 5 an additional rotatable paper guide means 17 of similar length to the printing platen is arranged to engage with the full width of the paper web immediately upstream with respect to paper feed, in the feed path for the web. The guide means 17 is so located that the small arc of contact of the paper web with the platen is sensibly symetrically disposed with respect to the point of printing. The guide means 17 is in the form of a paddle with four arms or blades 18. Any wrinkles 19 formed in the inner webs of the web because of the difference between the radii of the outer layers and inner layers during the period of contact of the web with the guide means can be accommodated in the grooves or spaces between the blades or arms 18 of the paddle. In other words the wrinkles are effectively absorbed by the paddle wheel 17. This accommodation feature prevents the formation in the inner layers of a bulge which in the absence of the paddle 17 would be progressively moved by the web movement towards the web crimping or clamping points (not shown). With the provision of the paddle it has been found that since the web 15 is substantially straightened out after passing the paddle 17 the wrinkles 19 are passed around the bend occupied by the paddle without being creased and with the result that as the feed path straightens out the wrinkles are pulled out again.

Whilst the FIGURE illustrates four paddles arms 18 the number of blades or arms is not critical since the main requirements are (a) there must be a sufficient gap between the arms 18 so as to be able to accommodate the wrinkles, and (b) the number of arms must be such as to avoid introducing a significant change in the web feed path length between the input and output sides of the feed round the paddle as the paddle rotates. By avoiding such path length change variations in the paper tension has been found to be prevented.

The free ends of the ribs or arms 17 are shaped for enabling the leading part thereof to make linear contact with the inner web of the strip material. Conveniently, each such end is shaped so as to present a smooth leading edge which is able to advance any wrinkle forming material during rotation so that the wrinkles form in the space that is in advance of the edge pushing against the strip material.

In the case of a four bladed wheel 17 it has been found that slight variations in the paper web path length are absorbed quite adequately by the natural "spring" in the paper web at the regions where it bends around the roller so that a substantially uniform tension is maintained in the system.

To facilitate the loading of the paper web a guide arrangement 20 is positioned adjacent to the paddle 17. This guide is of such shape that during loading the leading edge of the web is deflected in such direction as to pass around the paddle 17 and platen 5 towards the printing elements 6 into a position in which it is easily gripped by the operator.

The guide 20 is spaced a sufficient distance away from the paddle 17 so that any wrinkles 19 in the web 1 comprising a large number of copies can be readily accommodated.

The end of the guide arrangement adjacent to the platen is turned slightly inwards towards the platen to form a throat which is of such shape that it tends to smooth out the paper layers at the printing station.

In a modified arrangement the single full length paddle wheel can be replaced by a plurality of short paddle wheels each independenty rotatable on a common shaft.

Such an arrangement can be conveniently used in conjunction with printers having provision for side-by-side feeding of two or more independently driven paper webs, to avoid interaction of the different movements of the two webs one with the other via the common single paddle.

Although in the above the apparatus of the invention has been operationally considered in relation to printers such as are used with data processor installations it will be understood that the apparatus of the invention can be used wherever it is necessary, in a feed path for multilayer materials such as discussed above, to change direction of feed.

Furthermore, in relation to printers it may be convenient to incorporate more than one of the arrangements of the invention.

From the above it will be clear that by using the apparatus of the invention in the feed path of a multiweb paper it is possible to ensure that at any time it is necessary to pass the paper through a major arc, for example 180°, about a large diameter roll which would crease-in the wrinkles permanently or burst the edge binding of the paper, the extent of the arc is reduced sufficiently to avoid the wrinkle formation. This can be achieved by ensuring that the feed to the large diameter roll is such as to feed the paper tangentially so that during the actual feed wrinkles are removed from the paper before it contacts the roll.

I claim:

1. Apparatus including a platen rotatable about a first axis in a printer comprising a continuous cylindrical web supporting surface on said platten; a web guide freely rotatable about a second axis parallel with said first axis and comprising a plurality of arms extending radially from the second axis, each arm terminating in a two-dimensional web engaging surface, said web guide having web receiving recesses between the web engaging surfaces; a web comprising an outer layer and a plurality of inner layers; feeding means operative to engage continuously the layers to register the layers with one another and to feed the layers from the feeding means along a first path towards the web guide, the web then being drawn along a second path extending between the web guide and the platen; said feeding means also being operative to continuously re-engage the layers to maintain the layers in registration with one another after passing the platen and to draw the layers along a third path from the platen, the first and second paths being at an acute angel with respect to one another, said web being turned through said acute angle by the web guide and said outer layer lying radially outermmost; said second and third paths being at an obtuse angle with respect to one another and the web being turned through said obtuse angle by engagement with said continuous cylindrical web supporting surface with said outer layer lying radially outer-most; and tensioning means operative to tension the outer layer, the inner layers tending to wrinkle during passage around the web guide, said recesses being effective to accommodate the wrinkles and thereby ensure that registration of the layers is maintained during engagement of the web with the platen.

2. Apparatus as claimed in claim 1 in which said tensioning means includes a roller displaceable to vary the effective path length of the web around the web guide and the platen.

* * * * *